US007468002B2

(12) United States Patent
Robledo et al.

(10) Patent No.: US 7,468,002 B2
(45) Date of Patent: Dec. 23, 2008

(54) GAME UTILIZING A NON-SPHERICAL BILLIARD BALL

(75) Inventors: Devra L. Robledo, Anaheim, CA (US); Fred Robledo, Anaheim, CA (US)

(73) Assignee: SOURCENTERPRISES, Inc., Anaheim, CA (US)

( * ) Notice: Subject to any disclaimer, the term of this patent is extended or adjusted under 35 U.S.C. 154(b) by 0 days.

(21) Appl. No.: 11/604,662

(22) Filed: Nov. 27, 2006

(65) Prior Publication Data

US 2008/0125234 A1 May 29, 2008

(51) Int. Cl.
*A63D 15/00* (2006.01)

(52) U.S. Cl. ..... 473/52; 473/1

(58) Field of Classification Search ..... 473/1, 473/2, 52, 4, 6, 14
See application file for complete search history.

(56) References Cited

U.S. PATENT DOCUMENTS

| | | | | |
|---|---|---|---|---|
| 1,299,092 | A | | 4/1919 | Abrahamson |
| 2,524,546 | A | * | 10/1950 | Sinclaire ..... 473/570 |
| 3,195,267 | A | * | 7/1965 | Gehlen ..... 446/168 |
| 3,208,752 | A | * | 9/1965 | Pritchard ..... 273/118 A |
| 3,360,265 | A | | 12/1967 | Yabroudy |
| 3,712,627 | A | | 1/1973 | Stroud |
| 3,741,543 | A | | 6/1973 | McPhail et al. |
| 3,885,795 | A | | 5/1975 | Brewer |
| 3,930,650 | A | | 1/1976 | Watson |
| 3,937,467 | A | | 2/1976 | Benson et al. |
| 4,003,573 | A | | 1/1977 | Craig, Jr. |
| 4,116,439 | A | | 9/1978 | Chavarria et al. |
| 4,142,720 | A | | 3/1979 | Davis |
| 4,194,737 | A | | 3/1980 | Farmer |
| 4,526,368 | A | | 7/1985 | Furda |
| 4,616,827 | A | | 10/1986 | Bergland |
| 4,826,177 | A | | 5/1989 | Ponte |
| 4,834,384 | A | | 5/1989 | Cortesi |
| 4,930,777 | A | | 6/1990 | Holenstein |
| 4,986,542 | A | | 1/1991 | Bonnet |
| 4,991,844 | A | | 2/1991 | Derry |
| 5,042,803 | A | | 8/1991 | Fox et al. |
| 5,066,011 | A | | 11/1991 | Dykstra et al. |
| 5,070,610 | A | | 12/1991 | Leslie |
| 5,183,254 | A | | 2/1993 | Jones |
| 5,226,644 | A | | 7/1993 | Stone |
| 5,251,908 | A | | 10/1993 | Myers |
| 5,413,332 | A | | 5/1995 | Montgomery |

(Continued)

FOREIGN PATENT DOCUMENTS

| | | | |
|---|---|---|---|
| WO | WO/ 00 66234 | * | 11/2000 |

OTHER PUBLICATIONS

Golf Cross, the game played with the oval golf ball in English.*

(Continued)

*Primary Examiner*—Mitra Aryanpour
(74) *Attorney, Agent, or Firm*—Knobbe Martens Olson & Bear LLP

(57) ABSTRACT

A method of playing a game includes placing a non-spherical billiard ball on a surface. The non-spherical billiard ball has an ellipsoidal or ovoidal shape and a generally smooth outer surface lacking a concave portion. The method further includes rolling at least one spherical billiard ball along the surface generally towards the non-spherical billiard ball.

24 Claims, 18 Drawing Sheets

U.S. PATENT DOCUMENTS

| | | | | |
|---|---|---|---|---|
| 5,419,561 | A * | 5/1995 | Weber | 473/409 |
| 5,496,026 | A | 3/1996 | Montgomery | |
| D379,389 | S | 5/1997 | Shih | |
| 5,800,273 | A | 9/1998 | Potocki | |
| 5,833,548 | A | 11/1998 | Ellis et al. | |
| 5,893,791 | A * | 4/1999 | Wilkinson | 446/456 |
| 6,319,144 | B1 | 11/2001 | Hasty | |
| 6,537,125 | B1 | 3/2003 | Motosko | |
| D495,387 | S | 8/2004 | Shih | |
| D505,464 | S | 5/2005 | Shih | |
| 7,063,324 | B2 | 6/2006 | Kelley et al. | |
| 2005/0049086 | A1 | 3/2005 | Pavicich et al. | |

OTHER PUBLICATIONS

Golf Cross, the game played with the oval golf ball in French which has the details on the oval ball development.*
Billiard Bocce Balls Print-out from http://www.ebay.com.
Billiard Bocce Set Print-out from http://www.goboccee.com.
Billiard Table Bowls Print-out from http://www.hamiltonbilliards.com.
The Rules of Bowls Print-out from http://www.mastersgames.com.
The Oval Golfcross Ball Print-out from http://www.golfcross.com.
Maxafe Egg Ball Print-out from http://www.amazon.com.
Maxafe Egg Ball Print-out from http://www.fitnessgiant.com.

* cited by examiner

*Billiard Hand Bowling*

*Scoresheet*

| Teams: | A | | B | |
|---|---|---|---|---|
| (A1A2B1B2) (A1A2A3B1B2B3) | Game Points | Match X | Game Points | Match X |
| Game 1 A (1/5) | | | | |
| Game 2 B (2/5) | | | | |
| Game 3 A (3/5) | | | | |
| Game 4 B (1/6) | | | | |
| Game 5 A (2/6) | | | | |
| Game 6 B (3/6) | | | | |
| Less Foul Penalties | xx xx | xx xx | xx xx | xx xx |
| Round 1 Summary | | | | |

| Teams Change Sides (A1A2B2B1) ( ) | Play Individual Bonus Round (1/5) | | | |
|---|---|---|---|---|
| | Game Points | Match X | Game Points | Match X |
| Game 7 B (1/5) | | | | |
| Game 8 A (2/5) | | | | |
| Game 9 B (3/5) | | | | |
| Game 10 A (1/6) | | | | |
| Game 11 B (2/6) | | | | |
| Game 12 A (3/6) | | | | |
| Less Foul Penalties | xx xx | xx xx | xx xx | xx xx |
| Round 2 Summary | | | | |

| Teams Change Sides (A2A1B2B1) ( ) | Play Individual Bonus Round (2/6) | | | |
|---|---|---|---|---|
| | Game Points | Match X | Game Points | Match X |
| Game 13 A (1/5) | | | | |
| Game 14 B (2/5) | | | | |
| Game 15 A (3/5) | | | | |
| Game 16 B (1/6) | | | | |
| Game 17 A (2/6) | | | | |
| Game 18 B (3/6) | | | | |
| Less Foul Penalties | xx xx | xx xx | xx xx | xx xx |
| Round 3 Summary | | | | |

FIG. 10A

FIG. 10A

FIG. 10B

FIG. 10

| Teams Change Sides (A2A1B1B2) ( ) | Play Individual Bonus Round (3/5) Game Points | Match X | Game Points | Match X |
|---|---|---|---|---|
| Game 19 B (1/5) | | | | |
| Game 20 A (2/5) | | | | |
| Game 21 B (3/5) | | | | |
| Game 22 A (1/6) | | | | |
| Game 23 B (2/6) | | | | |
| Game 24 A (3/6) | | | | |
| Less Foul Penalties | xx xx | xx xx | xx xx | xx xx |
| Round 4 Summary | | | | |

Fouls:
Circle one X for each foul committed
Subtract one match for every two fouls committed
Subtract two points for every foul committed Summary

| | Points | X | Points | X |
|---|---|---|---|---|
| Round 1 Winner | | | | |
| Round 2 Winner | | | | |
| Round 3 Winner | | | | |
| Round 4 Winner | | | | |
| Total Points (All Rounds) | | | | |
| | | Total of X's | | Total of X's |
| Winner Totals | | | | |

FIG. 10A

FIG. 10B

FIG. 10

Individual Bonus Round

| Name | 1 | 2 | 3 | Total |
|---|---|---|---|---|
| A1 _____ | | | | |
| A2 _____ | | | | |
| A3 _____ | | | | |
| B1 _____ | | | | |
| B2 _____ | | | | |
| B3 _____ | | | | |

FIG. 10B

GAME UTILIZING A NON-SPHERICAL BILLIARD BALL

CROSS-REFERENCE TO RELATED APPLICATIONS

This application is related to U.S. patent application Ser. No. 11/604,663, entitled "Non-Spherical Billiard Ball" filed on even date herewith, and which is incorporated in its entirety by reference herein.

BACKGROUND OF THE INVENTION

1. Field of the Invention

The present invention relates generally to games or other types of entertainment or amusement, and more specifically to games utilizing balls used for billiards or other such games.

2. Description of the Related Art

Billiards is a general category of games which are played with balls on a table. Billiards includes carom games in which the object is to roll a cue ball to contact one or more other balls and a predetermined number of cushions or rails of the table. Billiards also include pocket billiard games (e.g., snooker and pool) in which the object is to roll a cue ball to hit one or more other balls into pockets of the table. Typically, the cue ball in billiards is rolled by striking it with a cue stick.

The size, weight, and shape of billiard balls are specified in regulations for each type of billiard game. For example, for pocket billiards, regulation balls are spherical with a diameter of 2¼ inches (57.15 millimeters) and a weight between 5½ and 6 ounces (156 to 170 grams). As another example, snooker balls are spherical with a diameter of 2 1/16 inches (52.4 millimeters) and balls for three-cushion billiards are spherical with a diameter of 2 7/16 inches (61.5 millimeters).

SUMMARY OF THE INVENTION

In certain embodiments, a method of playing a game comprises placing a non-spherical billiard ball on a surface. The non-spherical billiard ball has an ellipsoidal or ovoidal shape and a generally smooth outer surface lacking a concave portion. The method further comprises rolling at least one spherical billiard ball along the surface generally towards the non-spherical billiard ball.

In certain embodiments, an apparatus for playing a game comprises a non-spherical billiard ball having an ellipsoidal or ovoidal shape and a generally smooth outer surface lacking a concave portion. The apparatus further comprises a first plurality of spherical billiard balls.

BRIEF DESCRIPTION OF THE DRAWINGS

These and other features will now be described with reference to the drawings summarized below. These drawings and the associated description are provided to illustrate various embodiments, and not to limit the scope of the invention.

FIG. 10 (separated into FIGS. 10A and 10B) is an example score sheet in accordance with certain embodiments described herein.

DETAILED DESCRIPTION OF THE PREFERRED EMBODIMENT

Non-Spherical Billiard Ball

Figure 1:
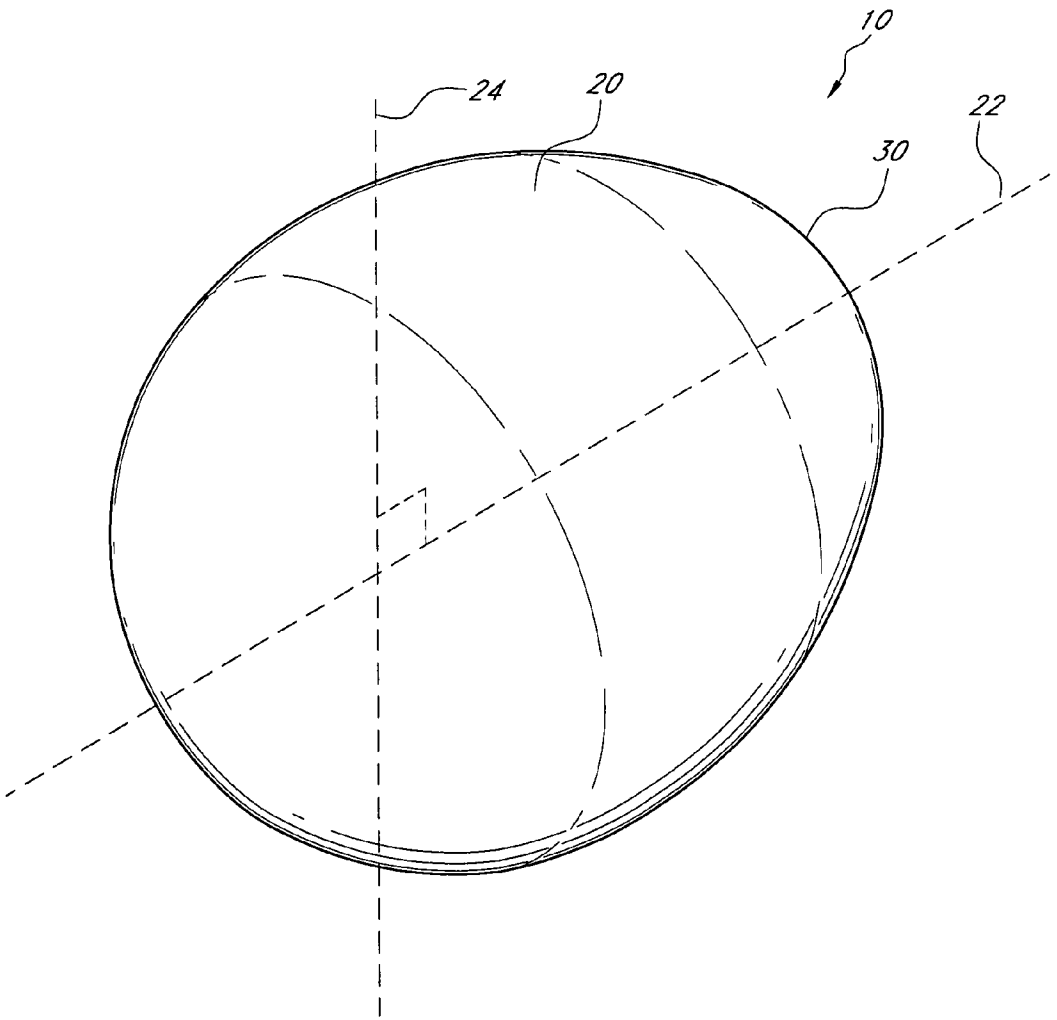
FIG. 1 schematically illustrates an example billiard ball compatible with certain embodiments described herein.

FIG. 1 schematically illustrates an example billiard ball 10 compatible with certain embodiments described herein. The billiard ball 10 comprises a generally incompressible body 20 having an ellipsoidal or ovoidal shape. The body 20 has a generally smooth outer surface 30 lacking a concave portion.

The body 20 is generally incompressible such that the body 20 does not appreciably deform upon application of force due to contact or impact of the billiard ball 10 with solid materials during normal use. As used herein, the term "incompressible" has its broadest ordinary meaning, including resistant to compression. For example, in certain embodiments, the body 20 does not comprise either compressible portions (e.g., hollow or air-filled portions) which are configured to allow the body 20 to reduce in volume upon compression of the body 20 or deformable portions (e.g., fluid-filled portions) which are configured to allow the body 20 to deform upon compression of the body 20. In certain embodiments, the body 20 comprises a material which is resilient to forces due to contact or impact with solid materials (e.g., other balls, cue sticks, or portions of the table with which it is used). The body 20 of certain embodiments can withstand compressive loads of about 10,000 pounds.

In certain embodiments, the body 20 is unitary such that the body 10 comprises a single piece of material. In certain such embodiments, the body 20 has a substantially uniform density throughout the body 20. In certain other embodiments, the body 20 comprises two or more solid pieces of material which are generally irreversibly coupled together (e.g., chemically bonded together by adhesive or fused together) to form the body 20. The body 20 of certain embodiments is generally resistant to scratches or burn spots from conditions experienced during normal play. Examples of man-made materials compatible with certain embodiments described herein include, but are not limited to, resin (e.g., phenolic resin, thermoset resin, Kobo resin, Partek resin) and polyester.

In certain embodiments, the weight of the body 20 is in a range between 5 ounces and 8 ounces, in a range between 6 ounces and 8 ounces, in a range between 5 ounces and 6 ounces, or in a range between 6 ounces and 7 ounces. In certain embodiments, the weight of the body 20 is selected to be approximately equal to the weight of a spherical ball with which the billiard ball 10 is to be used. Such a configuration advantageously provides more predictable collisions between the billiard ball 10 and the spherical ball since the energy transfer during the collision is similar to that of collisions between two spherical balls with the same weight. In certain other embodiments, the weight of the billiard ball 10 is selected to be larger than the weight of a spherical ball with which the billiard ball 10 is to be used. Such a configuration advantageously reduces the movement of the billiard ball 10 after a collision between the billiard ball 10 and the spherical ball as compared to collisions in which the weights of the two balls are equivalent. Other weights are also compatible with various embodiments described herein.

As schematically illustrated by FIG. 1, the billiard ball 10 of certain embodiments has a first diameter along a first direction 22 and a second diameter along a second direction 24 substantially perpendicular to the first direction 22, with the first diameter larger than the second diameter. In certain embodiments, the first diameter is in a range between 2 inches and 3 inches, and the second diameter is in a range between 1.5 inches and 2.5 inches. In certain other embodiments, the first diameter is in a range between 2.25 inches and 2.75 inches, and the second diameter is in a range between 1.75 inches and 2.25 inches. In still other embodiments, at least one of the first diameter and the second diameter is in a range between 2 inches and 2.5 inches (e.g., equals 2.25 inches) and the weight is in a range between about 5 ounces and about 8 ounces (e.g., in a range between 5.5 ounces and 6 ounces).

Figure 2A:
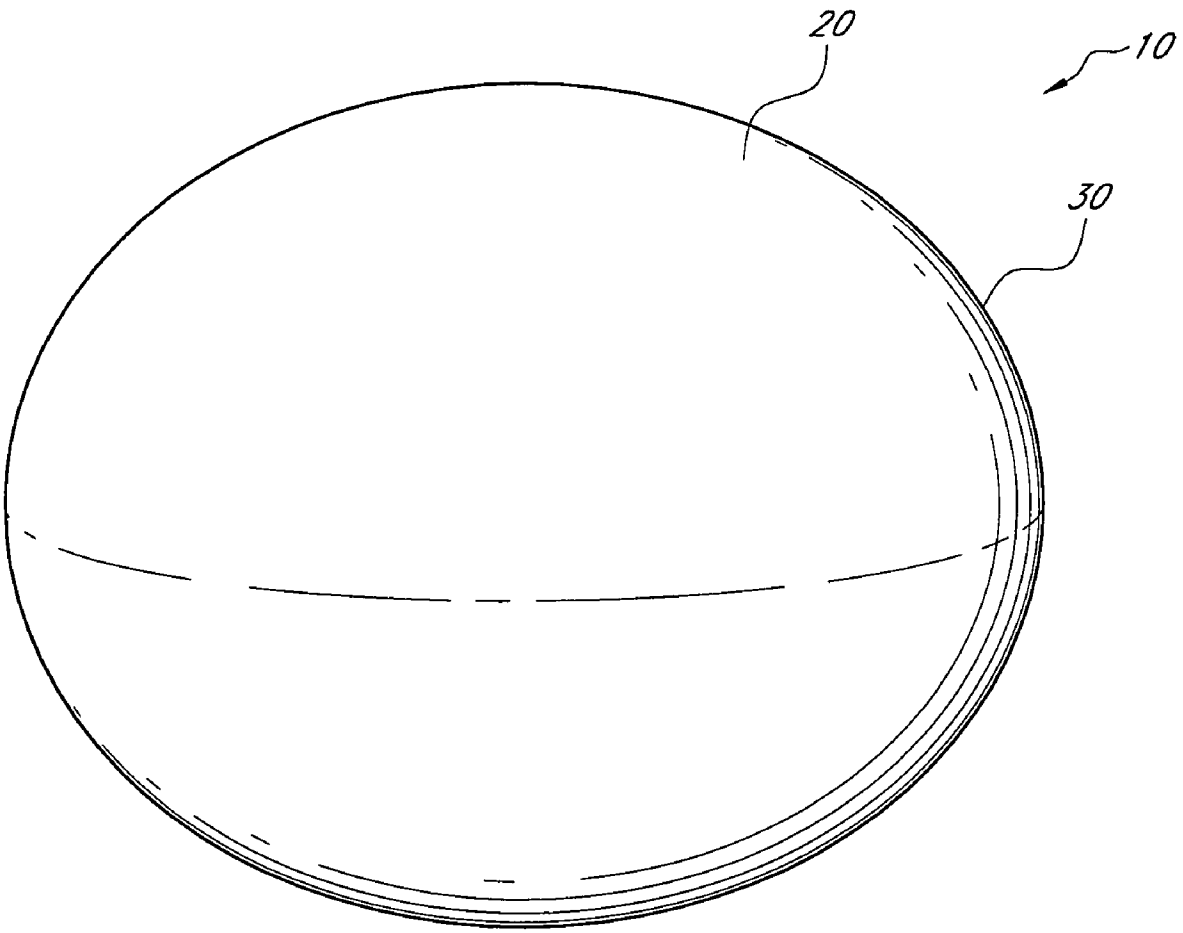
FIGS. 2A-2E schematically illustrate examples of billiard balls having an ellipsoidal-shape body.
Figure 2B:
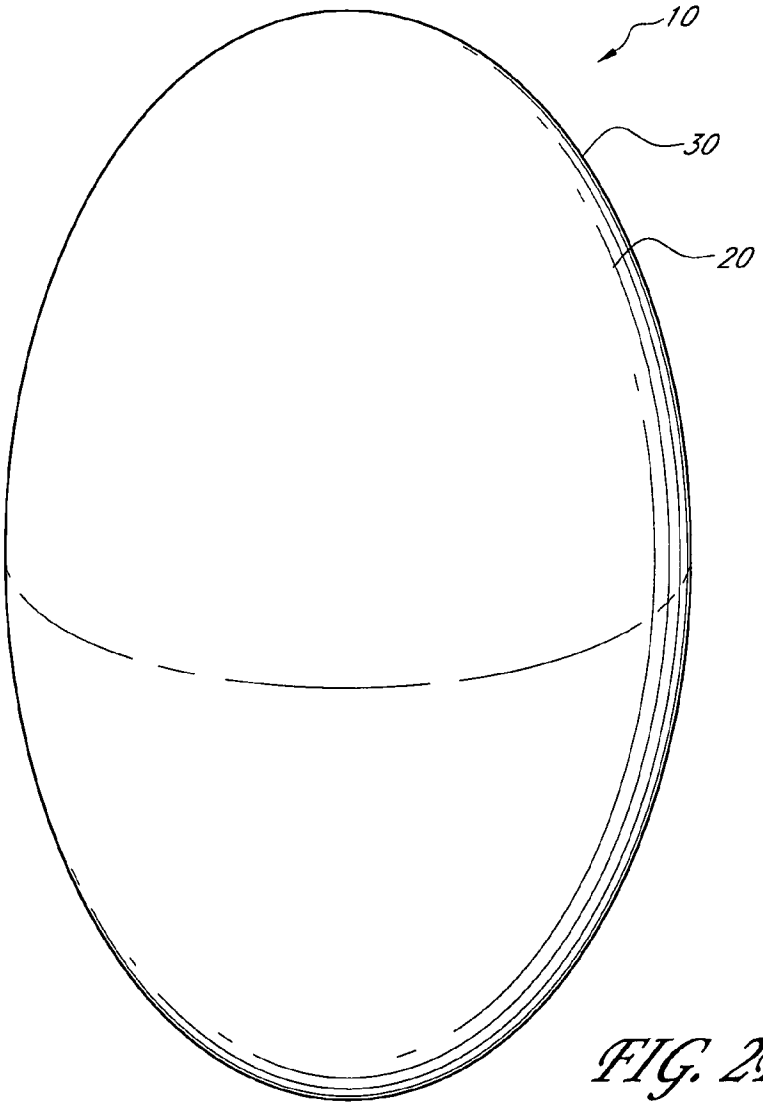
Figure 2C:
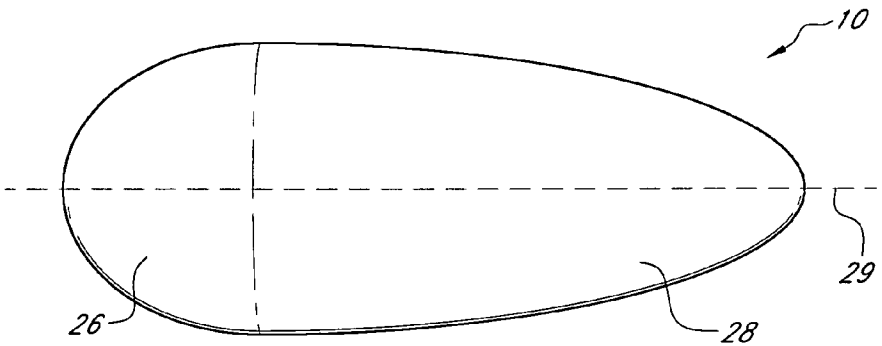
Figure 2D:
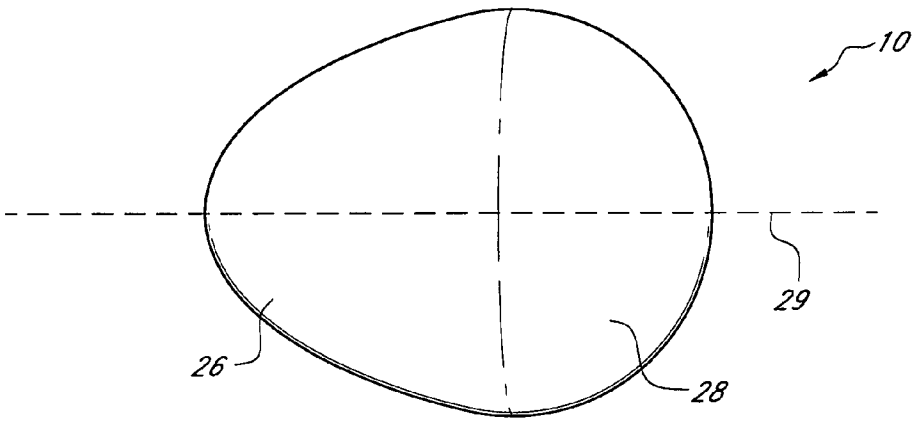
Figure 2E:
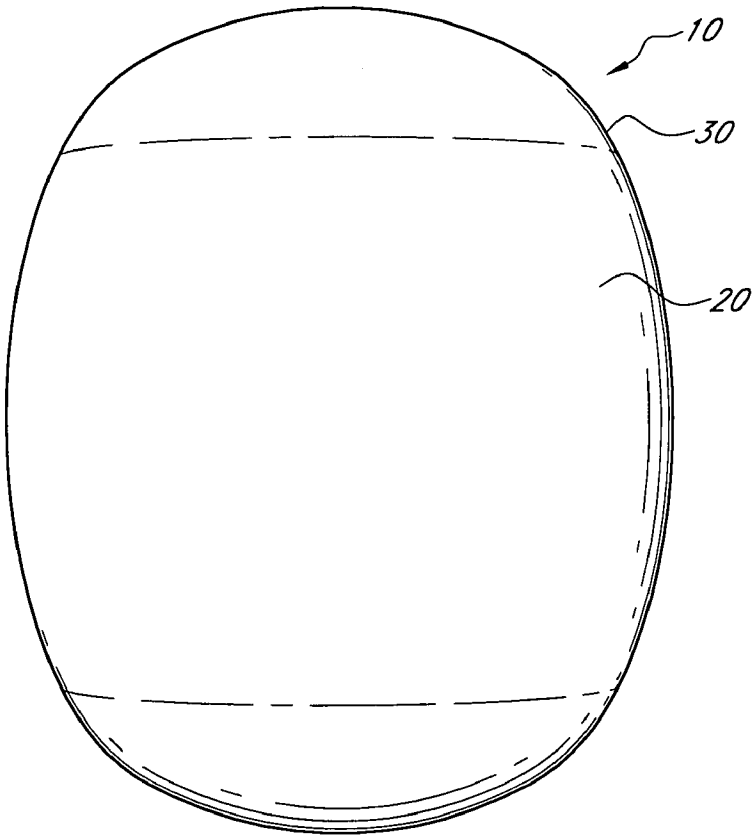

In certain embodiments, the body 20 has an ellipsoidal shape, as schematically illustrated by FIGS. 2A-2E. For example, the shape of certain embodiments is a spheroid (e.g., oblate as shown in FIG. 2A or prolate as shown in FIG. 2B). As used herein, the terms "ellipsoidal" and "spheroid" are used to refer to both their precise geometrical definitions as well as to shapes having minor variations from the precise geometrical definitions. In certain other embodiments, a first portion 26 of the body 20 has a prolate spheroid shape and a second portion 28 of the body 20 has an oblate spheroid shape, as schematically illustrated by FIG. 2C. In certain such embodiments, the first portion 26 and the second portion 28 are joined together at the equator and sharing a principal axis of rotational symmetry 29. The second portion 28 of certain embodiments has a generally spherical shape, and is joined to the spheroid-shaped first portion 26 at the equator and sharing a principal axis of rotational symmetry 29, as schematically illustrated by FIG. 2D. FIG. 2E schematically illustrates a body 20 having a superellipsoidal shape.

Figure 3A:
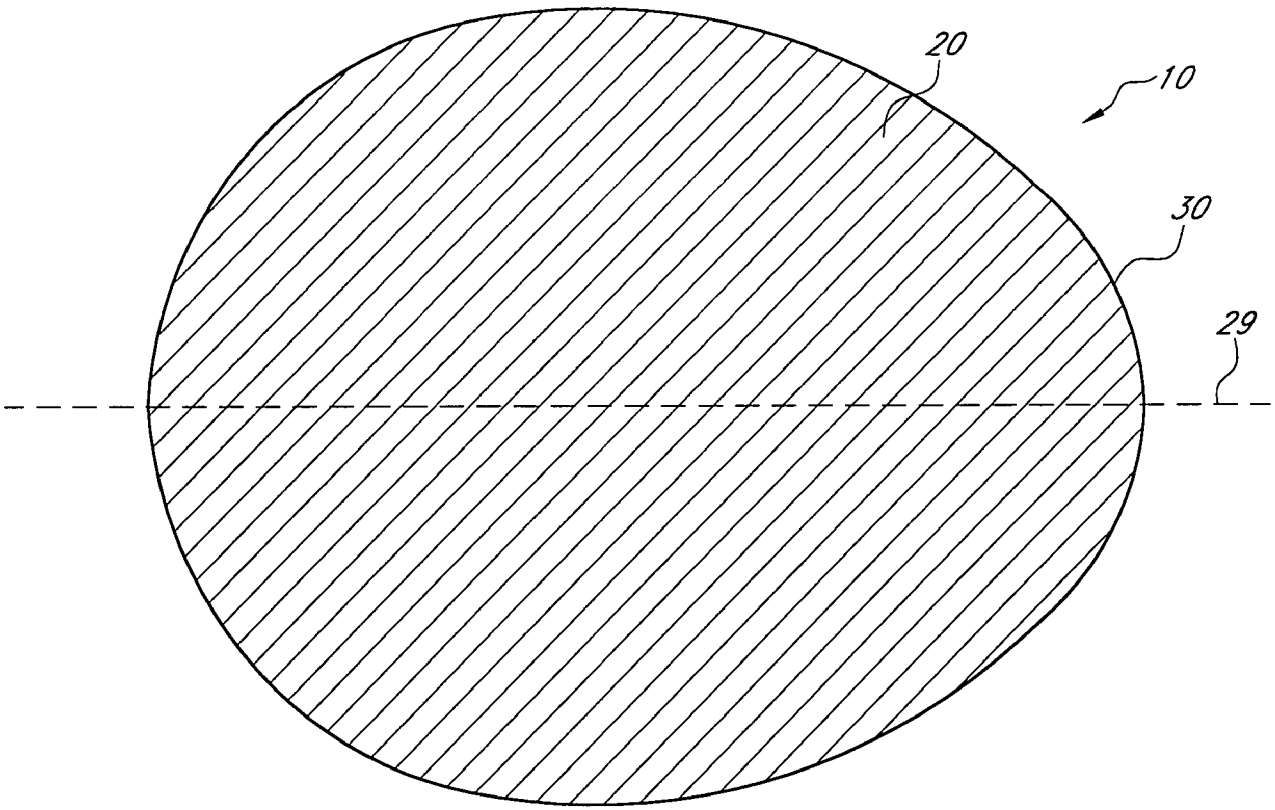
FIGS. 3A-3D schematically illustrate examples of billiard balls having an ovoidal-shaped body.
Figure 3B:
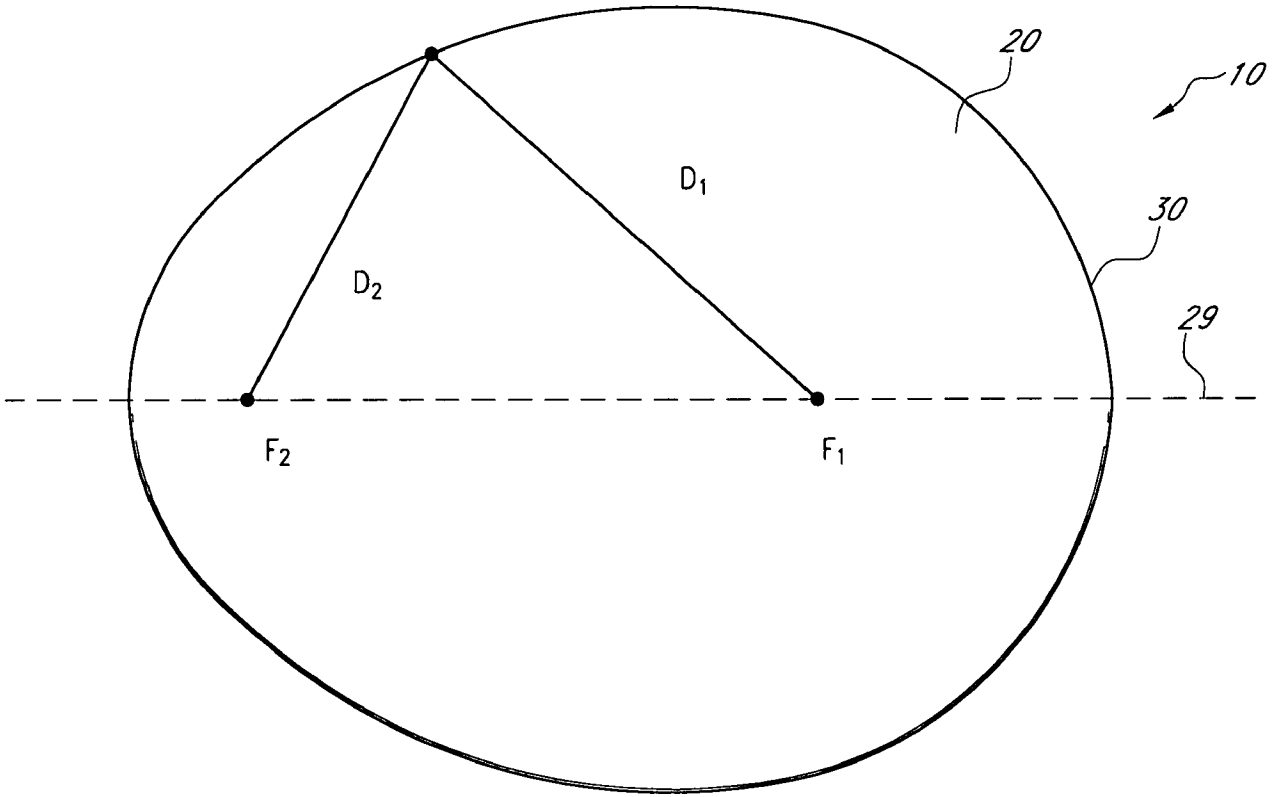
Figure 3C:
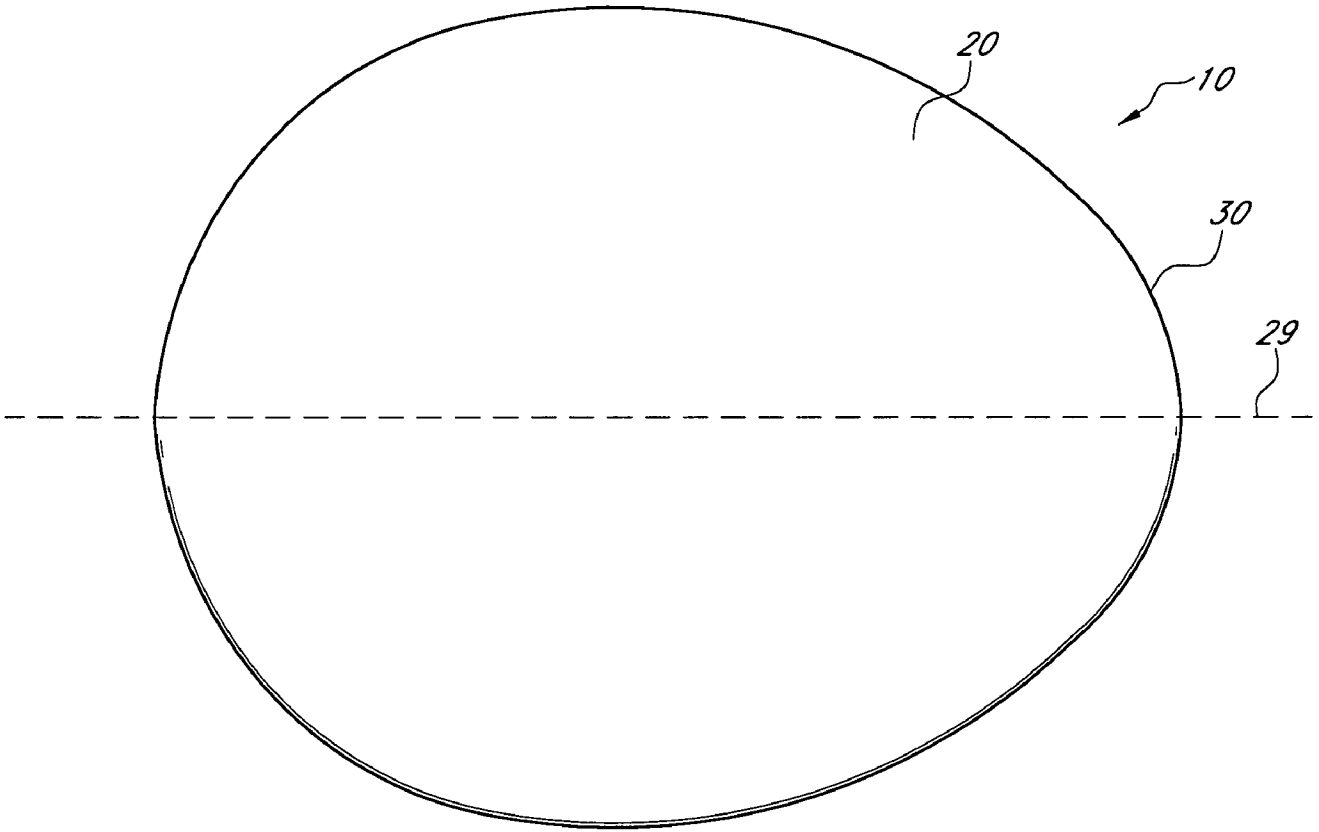
Figure 3D:
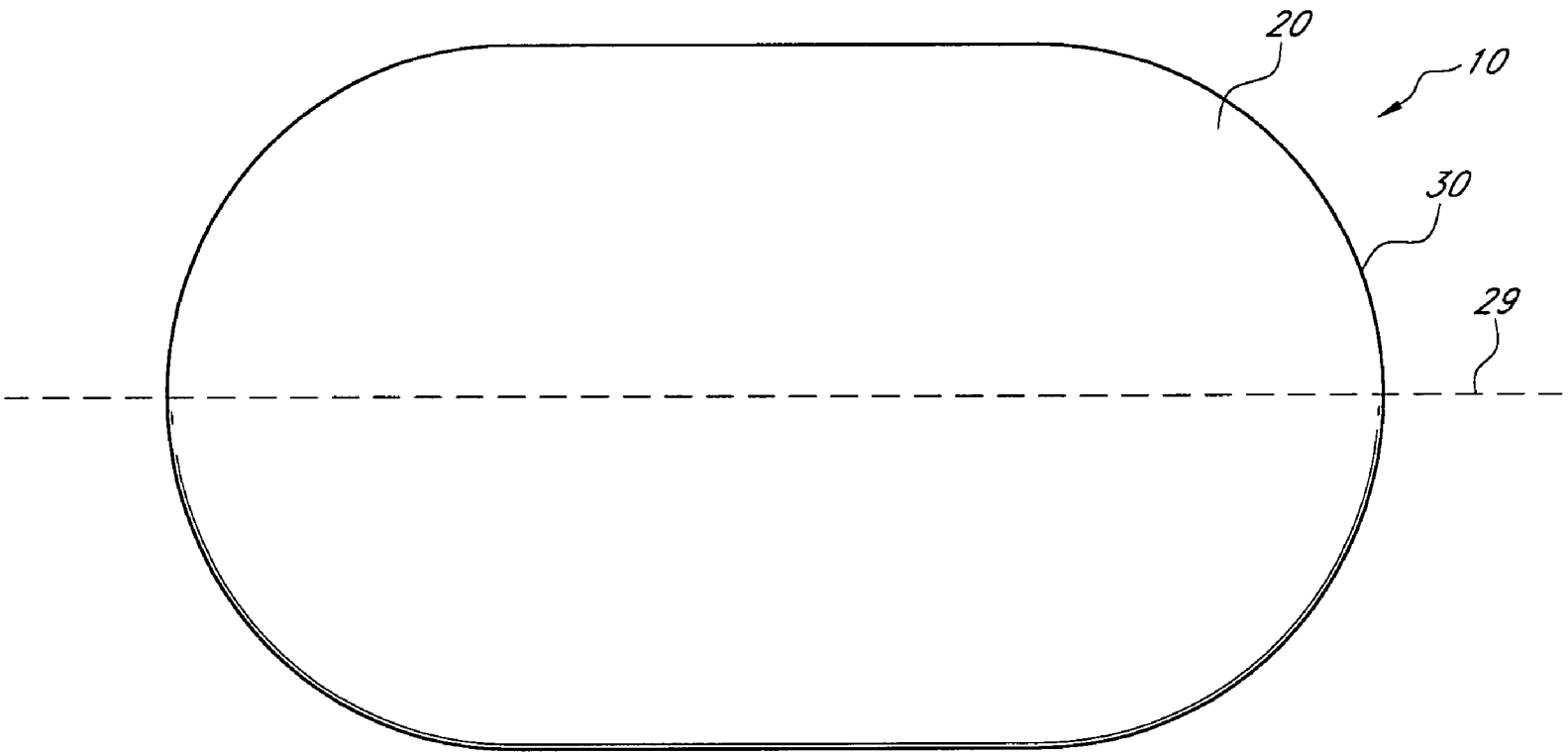

In certain embodiments, the body 20 has an ovoidal shape. For example, the shape of certain embodiments is generally egg-shaped, as schematically illustrated by FIG. 1. In certain embodiments, the ovoidal shape has an axis of rotational symmetry 29, a substantially circular cross-section in a plane perpendicular to the axis of rotational symmetry 29, and an oval cross-section in a plane along the axis of rotational symmetry 29, as schematically illustrated by FIG. 3A. An oval consisting of all the points for which the sum of the distance $D_1$ to one focus $f_1$ plus twice the distance $D_2$ to a second focus $f_2$ is a constant, as schematically illustrated by FIG. 3B, is a Cartesian oval. An oval consisting of all the points for which the product of their distances to two fixed points is a constant, as schematically illustrated by FIG. 3C, is a Cassini oval. As used herein, the terms "Cassini oval" and "Cartesian oval" are used to refer to both their precise geometrical definitions as well as to shapes having minor variations from the precise geometrical definitions. FIG. 3D schematically illustrates an oval cross-section comprising two semi-circles joined by straight sections. Other oval cross-sections can have elliptical or ovoidal portions joined by straight sections. Examples of oval cross-sections compatible with certain embodiments described herein include, but are not limited to, egg-shaped, Cassini oval, Cartesian oval, and shapes having two or more curved sections joined by straight sections (e.g., FIG. 3D).

FIG. 3B schematically illustrates the oval cross-section of a billiard ball 10 for which the oval cross-section is a Cartesian oval. In certain embodiments, the billiard ball 10 has the Cartesian oval shape with a length along the axis of rotational symmetry 29 of about 2.25 inches. Such a configuration can advantageously optimize the contact point between a 2.25-inch-diameter spherical ball and the billiard ball 10. In certain other embodiments, the billiard ball 10 has the Cartesian oval shape with a length along the axis of rotational symmetry 29 of about 2.5 inches. Such a configuration can advantageously optimize the contact point between the billiard ball 10 and a table rail having a height of about 1.375 inches. In still other embodiments, the billiard ball 10 has the Cartesian oval shape with a length perpendicular to the axis of rotational symmetry 29 of about 2.25 inches. Such a configuration can advantageously allow for the contact point between a 2.25-inch-diameter spherical ball and the billiard ball 10 to be centered, thereby allowing for similar reaction to occur from the contact of a spherical ball and the billiard ball 10 as occurs from the contact of two spherical balls having the same diameter. The length of the Cartesian oval shape along the axis of rotational symmetry 29 or perpendicular to the axis of rotational symmetry 29 can be advantageously selected to maximize the desired performance of the billiard ball 10 when used with other standard spherical billiard balls.

In certain embodiments, the billiard ball 10 having the Cartesian oval shape advantageously has the axis of rotational symmetry 29 for the oval equidistant from the table surface at all points when the billiard ball 10 is in a resting position. Thus, other balls are able to contact the billiard ball 10 at a point in parallel alignment with the axis of rotational symmetry 29 of the billiard ball 10. Because the Cartesian oval shape allows a consistent contact point on its axis of rotational symmetry 29, the movement of the billiard ball 10 after contact, though chaotic, may be considered predictable and may be quantified. For example, the following predictions of the movement of the billiard ball 10 may be made:

Contact in the middle: The billiard ball 10 will roll straight, and the distance the ball 10 will roll straight before starting to curve toward its heavier side is directly proportional to the velocity at which the billiard ball 10 was hit.

Contact at the larger end: The billiard ball 10 will roll in a radius direction toward the smaller end. The size of the radius is determined by the velocity at which the billiard ball 10 was hit.

Contact at the smaller end: The billiard ball 10 will pivot in a radius direction around the larger end. The rotation of this pivot is directly proportional to the velocity at which the billiard ball 10 was hit.

In addition to the velocity at which the billiard ball 10 is hit, other factors of dynamical systems, such as friction and mass, affect the behavior of the billiard ball 10 when contacted by other objects.

In certain embodiments, the outer surface 30 of the body 20 lacks structures which would at least partially impede smooth rolling of the billiard ball 10 along a flat surface. For example, in certain embodiments, the outer surface 30 of the body lacks a depression or a protuberance. In certain embodiments, the outer surface 30 of the body 20 lacks corners, edges, flats, or ridges.

Figure 4:
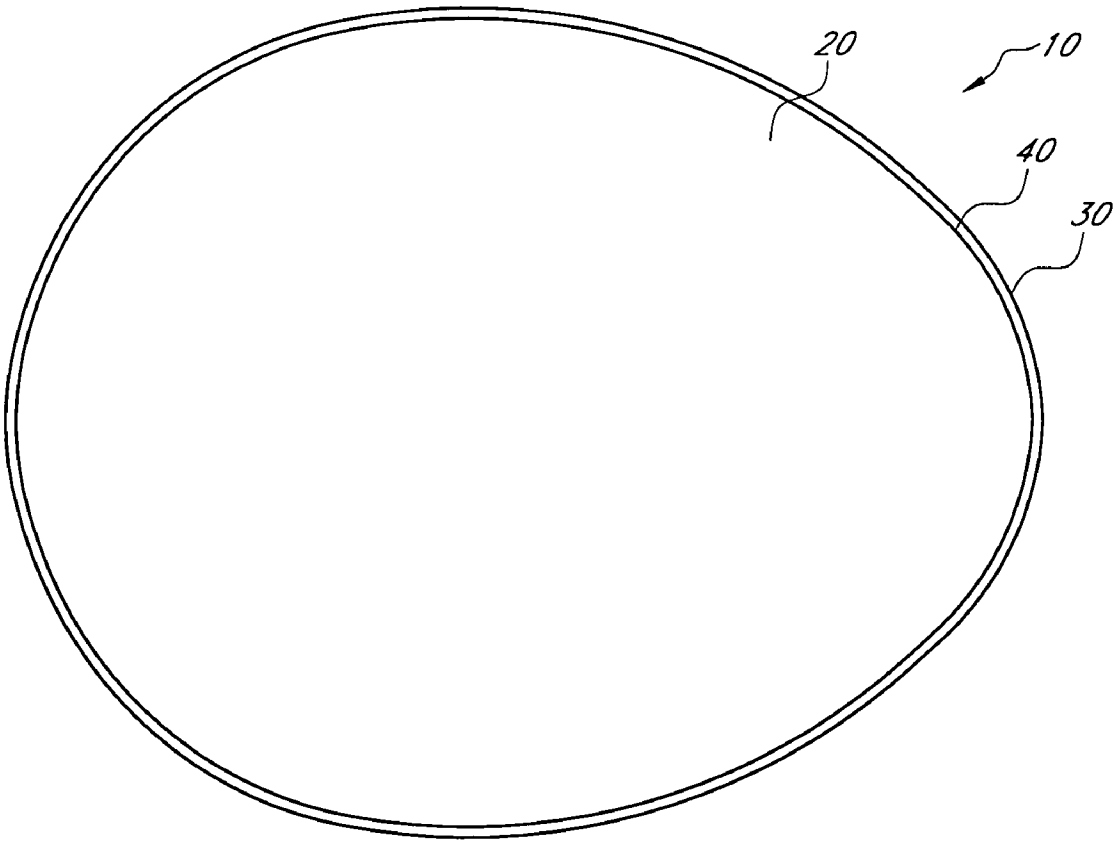
FIG. 4 schematically illustrates an example billiard ball having a covering in accordance with certain embodiments described herein.

In certain embodiments, the outer surface 30 of the body 20 is the outermost portion of the billiard ball 10. In certain other embodiments, the outer surface 30 is partially or wholly covered by a covering 40, as schematically illustrated by FIG. 4. In certain embodiments, the covering 40 comprises one or more layers of a material that provides coloring or design to the billiard ball 10. In certain embodiments, the covering 40 comprises elastomer, rubber, vinyl, plastic, paint, or other material. The covering 40 of certain embodiments is compressible such that it provides a cushion between the body 20 and any material which contacts or impacts the billiard ball 10 (e.g., other balls, cue sticks, portions of the table). In certain such embodiments, the covering 40 has an outer surface that is generally parallel to the outer surface 30 of the body 20 such that the outer surface of the covering 40 is generally smooth and lacks a concave portion.

Game Utilizing Non-Spherical Billiard Ball

In a dynamical system, an object moves according to one or more rules. For example, for a plurality of moving balls interacting with one another as they roll on a table, the rules of motion determine how each ball will move. The ball may move in a regular, predictable fashion, or it may move in an irregular, chaotic fashion. The kinematics of such dynamical systems include considerations of linear momentum, torque and angular acceleration, friction, glancing collisions, moment of inertia, conservation of energy, and rotational kinetic energy.

In certain embodiments, the billiard ball 10 allows a mixture of regular and chaotic dynamical behavior to occur when the billiard ball 10 interacts with the other elements of the game, including other billiard balls which are spherical and rails of the table. Thus, the use of the billiard ball 10 to a game setting introduces an element of unpredictability and intrigue. Typically, games are played with spherical balls and the laws of physics allow highly skilled players to control the balls to achieve the desired result to win the game. The billiard ball 10 of certain embodiments brings to the game an element of irregularity which causes the skilled player to consider possible alternative ball behavior and gives the unskilled player a certain amount of "luck" when the billiard ball 10 rolls in a direction to his favor. Introducing the billiard ball 10 in certain embodiments provides structure with both good and bad chaotic results similar to the use of dice in a game. The roll of the dice is unpredictable, but the player continues within the structure of the game based on the outcome of his last chaotic roll. Players using traditional spherical balls may plan their next one, two, or three moves because they depend on the laws of physics to accurately achieve the desired results. Onlookers and/or opponents are also great predictors of future moves or of moves that the player should have performed. When the billiard ball 10 of certain embodiments is introduced into the game, players, onlookers, and opponents must now contemplate "Plan B" and "Plan C" ball movements in case "Plan A" fails due to the chaotic movement of the billiard ball 10 disrupting the desired ball placement.

Figure 5:
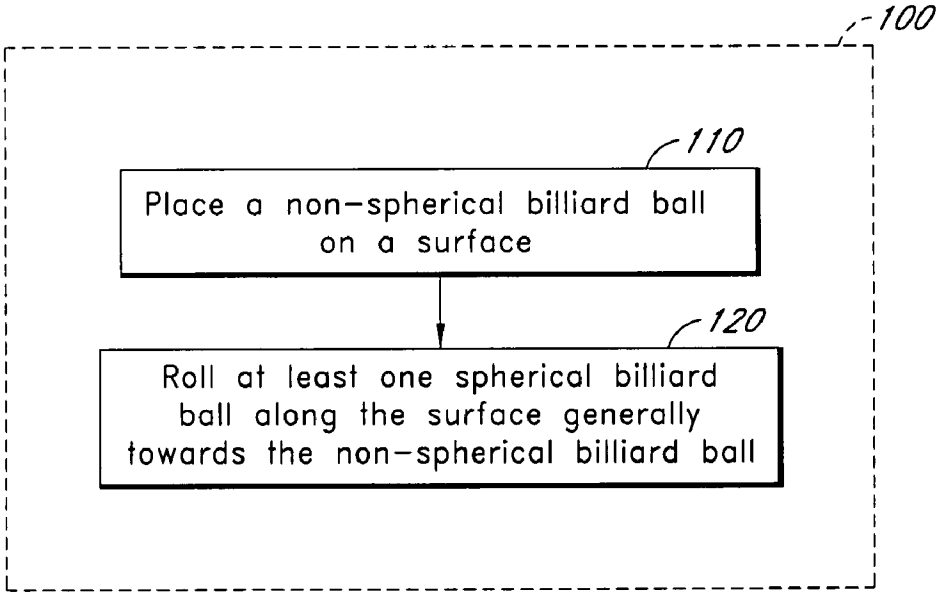
FIG. 5 is a flowchart of an example method of playing a game in accordance with certain embodiments described herein.
Figure 6:
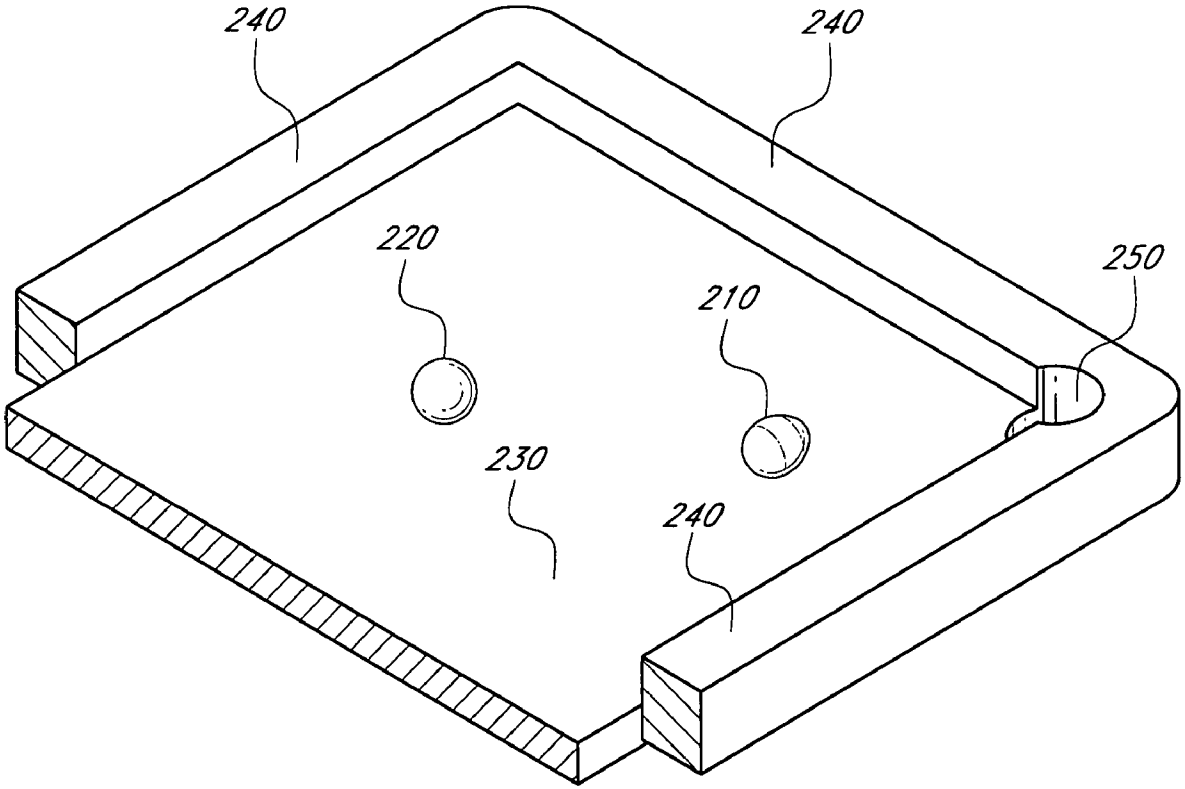
FIG. 6 schematically illustrates an example non-spherical billiard ball, spherical billiard ball, and surface compatible with certain embodiments described herein.

FIG. 5 is a flowchart of an example method 100 of playing a game in accordance with certain embodiments described herein. FIG. 6 schematically illustrates a non-spherical billiard ball 210, a spherical billiard ball 220, and a surface 230 compatible with certain embodiments described herein. The method 100 comprises placing a non-spherical billiard ball 210 on a surface 230 in an operational block 110. The non-spherical billiard ball 210 has an ellipsoidal or ovoidal shape and a generally smooth outer surface lacking a concave portion. The method 100 further comprises rolling at least one spherical billiard ball 220 along the surface 230 generally towards the non-spherical billiard ball 210 in an operational block 120.

Examples of non-spherical billiard balls 210 compatible with the method 100 are schematically illustrated by FIGS. 1, 2A-2E, 3A-3D, and 4 and are described herein. In certain embodiments described herein, two or more such non-spherical billiard balls 210 are used.

In certain embodiments, the at least one spherical billiard ball 220 comprises one or more regulation billiard balls. For example, a spherical billiard ball 220 compatible with certain embodiments described herein has a weight between 5.5 ounces and 6 ounces and a diameter of about 2.25 inches with a tolerance of ±0.005 inch. In certain embodiments, the at least one spherical billiard ball 220 comprises two to eight spherical billiard balls.

In certain embodiments, the surface 230 is a generally horizontal, flat, and smooth surface along which the non-spherical billiard ball 210 and the at least one spherical billiard ball 220 are free to roll. For example, the surface 230 of certain embodiments is the playing surface of a billiards table. In certain embodiments, the surface 230 is a table surface having one or more cushioned rails 240 along corresponding edges of the surface 230, as schematically illustrated by FIG. 6. The rails 240 are configured to allow the non-spherical billiard ball 210 and the at least one spherical billiard ball 220 to impact and bounce from the rails 240 without damaging either the ball or the rail 240. The rails 240 of certain embodiments serve to confine the non-spherical billiard ball 210 and the at least one spherical billiard ball 220 on the surface 230. In certain embodiments, the table comprises one or more pockets 250 in which the spherical balls 220 can fall. In certain embodiments, the non-spherical billiard ball 210 is capable of falling into the pockets 250 as well. The pockets 250 can be distributed along the edges of the surface 230, at corners at which two edges of the surface 230 intersect, at various positions of the surface 230 away from the edges, or at combinations thereof.

In certain embodiments, the at least one spherical billiard ball 220 comprises a plurality of spherical billiard balls (e.g., between 2 and 15 spherical billiard balls 220). In certain embodiments, all the spherical billiard balls 220 are identical to one another, while in certain other embodiments, each spherical billiard ball 220 has one or more identifying indicia (e.g., color, number, letter, image) used to distinguish the spherical billiard ball 220 from the others. For example, the spherical billiard balls 220 can each have different identifying indicia corresponding to different playing cards.

The at least one spherical billiard ball 220 of certain embodiments comprises a first plurality of spherical billiard balls and a second plurality of spherical billiard balls. In certain embodiments, the second plurality of spherical billiard balls comprises the same number of spherical billiard balls (e.g., 2, 3, 4, 5, 6, 7, or 8 spherical billiard balls) as does the first plurality of spherical billiard balls. In certain embodiments, each spherical billiard ball 220 of the first plurality of spherical billiard balls has one or more corresponding indicia with a first element common among the indicia of the first plurality of spherical billiard balls. In addition, each spherical billiard ball 220 of the second plurality of spherical billiard balls has one or more corresponding indicia with a second element common among the indicia of the second plurality of spherical billiard balls, where the second element is different from the first element. The different indicia can be used to distinguish the first plurality of spherical billiard balls from the second plurality of spherical billiard balls, to distinguish the spherical billiard balls of a common plurality from one another, or both.

For example, the first plurality of spherical billiard balls can have a common first color or range of colors (e.g., red or varying shades of red) and the second plurality of spherical billiard balls can have a common second color or range of colors (e.g., blue or varying shades of blue). Thus, each spherical billiard ball of the first plurality includes the first color and each spherical billiard ball of the second plurality includes the second color which is different from the first color. As another example, the first plurality of spherical billiard balls can have varying solid colors (e.g., the solid colors of the 1-ball through the 7-ball of a standard set of billiard balls) and the second plurality of spherical billiard balls can have stripes of varying colors (e.g., the stripes of varying colors of the 9-ball through the 15-ball of a standard set of billiard balls). As still another example, the first plurality of spherical billiard balls can have symbols or a type of symbols of the same or common type (e.g., diamonds) and the second plurality of spherical billiard balls can have symbols or a type of symbols of the same or common type but different from that of the first plurality of spherical billiard balls (e.g., spades). In certain other embodiments, these and other types of indicia may be used individually or together to provide a means for distinguishing the spherical billiard balls of the first plurality from the spherical billiard balls of the second plurality.

In certain embodiments, the non-spherical billiard ball 210 has one or more indicia which are different from the indicia of the first plurality of spherical billiard balls and different from the indicia of the second plurality of spherical billiard balls. For example, the non-spherical billiard ball 210 can have a different color, a different pattern, or a different symbol than do any of the spherical billiard balls of the first plurality or the second plurality.

In certain embodiments, placing the non-spherical billiard ball 210 on the surface 230 comprises imparting a force on the non-spherical billiard ball 210 to roll the non-spherical billiard ball 210 along the surface 230. The force is imparted on the non-spherical billiard ball 210 manually in certain embodiments (e.g., by placing the non-spherical billiard ball 210 at a predetermined location on the surface 230 by hand or by rolling the non-spherical billiard ball 210 to a location on the surface 230 by rolling the non-spherical billiard ball 210 by hand). In certain embodiments, the force is imparted on the non-spherical billiard ball 210 by striking the non-spherical billiard ball 210 with a stick (e.g., a cue stick as used in a conventional game of billiards). In certain embodiments, the force is imparted on the non-spherical billiard ball 210 by striking the non-spherical billiard ball 210 by a spherical billiard ball which has been propelled in a direction (e.g., by hand or by striking the spherical billiard ball with a cue stick) so as to strike the non-spherical billiard ball 210.

In certain embodiments, rolling the at least one spherical billiard ball 220 along the surface 230 comprises imparting a force on the at least one spherical billiard ball 220 manually (e.g., by rolling the spherical billiard ball 220 by hand), by striking the at least one spherical billiard ball 220 with a stick (e.g., a cue stick as used in a conventional game of billiards), or by striking the at least one spherical billiard ball 220 with another spherical billiard ball. In certain embodiments in which the surface 230 is a table surface having one or more cushioned rails 240 along corresponding edges of the surface 230, rolling the at least one spherical billiard ball 220 generally towards the non-spherical billiard ball 210 comprises rolling the at least one spherical billiard ball 220 towards the one or more cushioned rails 240 such that the at least one spherical billiard ball 220 impacts the one or more cushioned rails 240 and changes trajectory generally towards the non-spherical billiard ball 210. In certain such embodiments, the at least one spherical billiard ball 220 impacts a first cushioned rail 240 and changes trajectory towards a second cushioned rail 240, impacts the second cushioned rail 240 and changes trajectory generally towards the non-spherical billiard ball 210.

In certain embodiments, the method 100 further comprises placing a second non-spherical billiard ball on the surface. The second non-spherical billiard ball has an ellipsoidal or ovoidal shape with a generally smooth outer surface lacking a concave portion. In certain embodiments, the second non-spherical billiard ball is identical to the first non-spherical billiard ball 210, while in certain other embodiments, the second non-spherical billiard ball has a different shape, color, design, or other indicia than does the first non-spherical billiard ball 210 so as to distinguish the two from one another. In certain embodiments, the method 100 further comprises rolling the at least one spherical billiard ball 220 along the surface 230 generally towards the second non-spherical billiard ball.

The following description provides various examples of games compatible with certain embodiments described herein. Persons skilled in the art recognize that other games are also compatible with certain embodiments described herein.

EXAMPLE 1

Hand Billiard Game Using Non-Spherical Billiard Ball

In the game of Example 1, one non-spherical billiard ball 300, a first set of spherical billiard balls 310, a second set of spherical billiard balls 320, and a billiards table 330 are used. The two sets of spherical billiard balls each have six spherical billiard balls, and the two sets have different indicia (e.g., one set is light in color, the other set is dark in color). Two to six players are organized in two teams, Team A and Team B, each having a team captain. Teams need not have the same number of players. Table 1 provides possible combinations of two to six players into Teams A and B:

TABLE 1

| Number of players | Team A | Team B |
|---|---|---|
| 2 | 1 | 1 |
| 3 | 2 | 1 |
| 4 | 2 | 2 |
| 5 | 3 | 2 |
| 6 | 3 | 3 |

Figure 7:
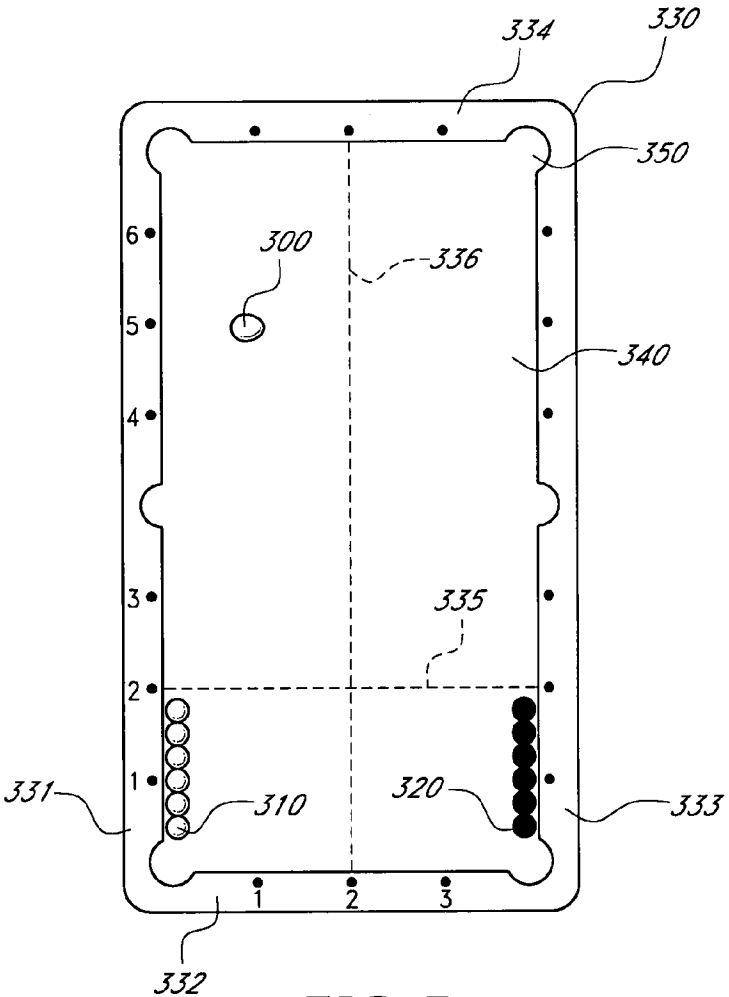
FIG. 7 schematically illustrates the starting positions of the non-spherical billiard ball and the spherical billiard balls at the beginning of the first game of a set.

FIG. 7 schematically illustrates the set-up conditions for the game. In the following description, reference is made to various positions on the table 330 by referring to the markings (e.g., diamonds) that are located on the left side rail 331, the foot rail 332, the right side rail 333, and the head rail 334. A notation of Fx-Sx is used herein where F stands for foot rail and S stands for side rail. The foot rail 332 has three markings denoting positions F1, F2, and F3. Each of the side rails 331, 333 has six markings denoting positions S1, S2, S3, S4, S5, and S6. The position is determined by counting the markings from left to right and from bottom to top from the foot rail perspective. The foot string 335 is defined to be the line at S2, and the long string 336 is defined to be the line at F2.

A standard match consists of four sets and each set consists of six games, but other variations are possible. Teams rotate around the table after each set in order to both equalize and vary the rolling perspectives of the players. For example, following the first set, the teams change sides (left and right); following the second set, the teams stay on the same side but change ends (foot and head); and after the third set, the teams change sides (left and right). Once the rotation occurs, the new team position is played throughout all six games of the set until the next set begins. The rotation of the non-spherical billiard ball 300 is identical in all four sets, however, the foot rail 332 and the head rail 334 reverse during the third and fourth set so that players may gain experience from both ends of the table. The rotation instructions are written on the score sheets.

At the start of a game, Team A places their six spherical billiard balls 310 on the table 330 along the left side rail 331 between the foot rail 332 and the foot string 335, and Team B places their six spherical billiard balls 320 on the table 330 along the right side rail 334 between the foot rail 332 and the foot string 333. The spherical billiard balls placed along the left side rail 331 and the right side rail 334 are termed "resting billiard balls" because they have not yet been rolled into play.

Figure 8:
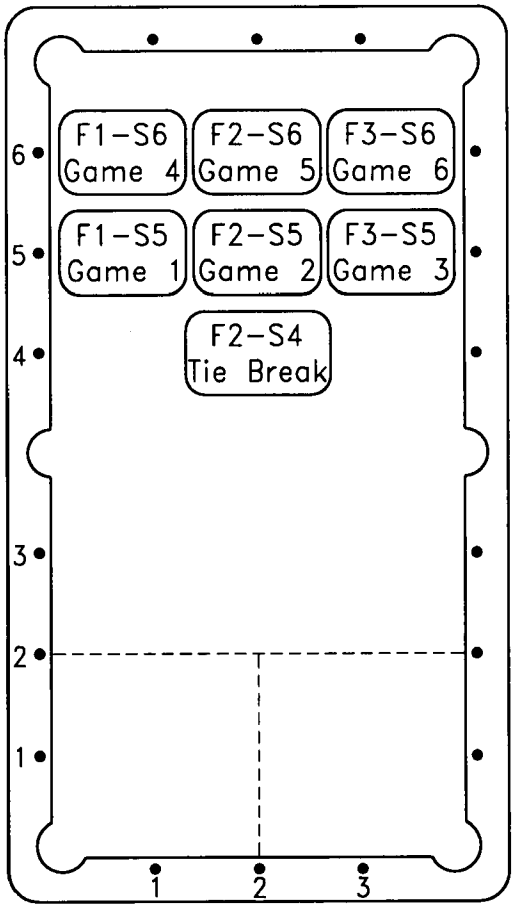
FIG. 8 schematically illustrates the starting positions of the non-spherical billiard ball for the six games of a set and for a tie-breaking game.

For the first game in a set, the non-spherical billiard ball 300 is placed at a position F1-S5, as shown in FIG. 7. For the start of each game of the set, the non-spherical billiard ball 300 is placed at a different position. The same rotating position of the non-spherical billiard ball is followed in the six games for each of the four sets. As viewed from the foot rail, the positioning pattern for the non-spherical billiard ball is provided in Table 2 and shown schematically in FIG. 8.

TABLE 2

| | |
|---|---|
| Game 1 | Position F1-S5 |
| Game 2 | Position F2-S5 |
| Game 3 | Position F3-S5 |
| Game 4 | Position F1-S6 |
| Game 5 | Position F2-S6 |
| Game 6 | Position F3-S6 |
| Tie Breaker | Position F2-S4 |

The placement of the non-spherical billiard ball 300 is approximate to the intersection of the positions indicated by Table 2, and the player placing the non-spherical billiard ball 300 may position the non-spherical billiard ball 300 at the angle of his choosing. Exact placement of the non-spherical billiard ball 300 is not critical to the successful play of the game. For example, the non-spherical billiard ball 300 can be placed within two inches of the intersection indicated.

A legal roll is defined as a player standing behind the foot rail and rolling a team spherical billiard ball by hand towards the game playing region 340 which is defined as the region between the foot string and the head rail. All spherical billiard balls rolled by players during game play must be legal rolls. If a player commits a foul, the appropriate penalty is employed.

A legal roll conforms to the following rules. A player who does not roll a legal roll has committed a foul. Penalties for fouls vary accordingly to the type of foul committed and, in some situations, when the foul occurs during the course of playing the game.

Legal roll rule 1: A player must release his hand from the spherical billiard ball by the time the spherical billiard ball reaches the foot string, and a player's hand may not extend past the foot string. If a foul of this rule is committed, the game continues and the penalty is the notation of a foul being accumulated on the score sheet for the team committing the foul and the final score will be reduced according to the scoring rules for each foul committed.

Legal roll rule 2: A player may not touch the spherical billiard ball again once he has released the spherical billiard ball into a rolling motion. If a foul of this rule is committed, the game continues and the penalty is the notation of a foul being accumulated on the score sheet for the team committing the foul and the final score will be reduced according to the scoring rules for each foul committed.

Legal roll rule 3: A player must remain to the left or the right of the long string depending on which quadrant of the table his team is currently positioned. A player may bank a spherical billiard ball against the cushion on the opposing team's side of the table, but only from a standing position from his own team's side of the table. If a foul of this rule is committed, the game continues and the penalty is the notation of a foul being accumulated on the score sheet for the team committing the foul and the final score will be reduced according to the scoring rules for each foul committed.

Legal roll rule 4: A player must roll the spherical billiard ball in such a manner that the spherical billiard ball remains in contact with the table surface at all times. No player may toss, throw, or bounce any spherical billiard ball at any time during the game. If a foul of this rule is committed, the game continues and the penalty is the notation of a foul being accumulated on the score sheet for the team committing the foul and the final score will be reduced according to the scoring rules for each foul committed.

Legal roll rule 5: A player must wait for the motion of all spherical and non-spherical billiard balls on the table to stop before rolling another spherical billiard ball into play or before removing a spherical billiard ball from play. If a foul of this rule is committed, the game continues and if the spherical billiard ball contacts another spherical or non-spherical billiard ball that is in motion, the penalty is the notation of a foul being accumulated on the score sheet for the team committing the foul and the final score will be reduced according to the scoring rules for each foul committed.

Legal roll rule 6: A player must not prematurely stop and remove a moving spherical or non-spherical billiard ball that has rolled out of the game playing region 340 and into the resting billiard ball area (between the foot rail and the foot string). If a foul of this rule is committed, the game continues and the penalty is the notation of a foul being accumulated on the score sheet for the team committing the foul and the final score will be reduced according to the scoring rules for each foul committed.

Legal roll rule 7: Unless playing a version of the game in which no banking of the spherical billiard ball is required, a spherical billiard ball rolled into motion must contact a cushion before contacting any other spherical or non-spherical billiard ball on the table. If a foul of this rule is committed, the game in play is void and is replayed, and the penalty is the notation of a foul being accumulated on the score sheet for the team committing the foul and the final score will be reduced according to the scoring rules for each foul committed.

The object of the game is to roll the team spherical billiard balls 310, 320 by hand to a position on the table 330 as close to the non-spherical billiard ball 300 as possible. In one variation of the game, the team spherical billiard balls 310, 320 must bank against a minimum of one cushion on the table before contacting any other spherical or non-spherical billiard balls. In another variations, the requirement of using one bank may be eliminated (e.g., for beginning players) or the requirement of banking against two or more cushions may be added (e.g., for advanced players). In still other variations, the required number of banks can be determined on a player-by-player basis, depending on the skill level of the individual players.

Play begins by a chosen player from Team A rolling one of his team's spherical billiard balls 310 by hand onto the table towards the non-spherical billiard ball 300, with the condition that he must bank the spherical billiard ball 310 against a minimum of one cushion before contacting any other spherical or non-spherical billiard balls. Next, the chosen player from Team B rolls one of his team's spherical billiard balls 320 towards the non-spherical billiard ball 300, with the same condition of one bank before contacting any other spherical or non-spherical billiard balls. These same two players from Team A and Team B continue to alternate rolls until all six of the respective team spherical billiard balls are rolled. This defines the completion of one game.

For one-person teams, the same player will play all games in a set and all sets in a match. For two-person teams, the team members will alternate playing the games through the completion of the set. For three-person teams, the team members will cycle playing the games through the completion of the set. Other permutations of the team members playing the games of the set may also be used.

After the first set, the rotation changes so that players are not continuing to play against the same opponent for all sets (except for one-person teams). The rotation for each of the sets is designated on the score sheet so that referencing the score sheet will inform players of their new playing rotation for the set about to be played.

The non-spherical billiard ball 300 must remain in the game playing region 340. If the non-spherical billiard ball 300 is hit into a pocket 350, or hit and stops on the surface between the foot rail 332 and the foot string 335, or hit off of the table 330, the game is void and must be replayed. Strategic playing may cause a team to attempt voiding a game by one of the above methods, however, a penalty is imposed if the non-spherical billiard ball 300 is hit off of the table 330. When the non-spherical billiard ball 300 is hit off of the table 300, the game is void and is replayed with the team that caused the non-spherical billiard ball 300 to come off the table 330 receiving a foul recordable on the score sheet. If the game was voided by legitimate means (e.g., the non-spherical billiard ball 300 falling into a pocket 350), then the game is replayed without penalty.

A player is allowed to bank his spherical billiard ball against any cushion during his turn. However, if he chooses to use any cushion between the foot rail 332 and the foot string 335, he may not hit any of the resting spherical billiard balls set up and waiting to play in that area. If his spherical billiard ball does hit these resting balls on his initial release of the roll, it is a foul recordable on the score sheet.

A player is allowed to bank his spherical billiard ball against any other spherical or non-spherical billiard ball in play on the surface. However, as stated above, the player must first bank his spherical billiard ball against a cushion prior to contacting any of the other spherical or non-spherical billiard balls.

Any spherical billiard ball which rolls back into and stops between the foot rail 332 and the foot string 335 is dead and must be pocketed. No additional penalty is imposed. If this same spherical billiard ball hit resting billiard balls not in play causing these balls to hit other balls in play, the game is void and must be replayed. However, if the resting billiard balls that were hit have not disrupted the game play by hitting balls within the game playing region 340 and can be replaced to their set-up positions without controversy, the game may continue after doing so.

A player who hits any team spherical billiard ball off of the table 330 voids the game and the game is replayed. "Off of the table" is defined as hitting a ball so that it does not land on the table surface between the foot rail 332 and the head rail 334 or into a pocket 350. When a team spherical billiard ball is hit off of the table 330, the game is void and replayed with the team who caused the billiard ball to come off of the table receiving a foul recordable on the score sheet. A team spherical billiard ball that is pocketed is considered "dead" and no penalty is imposed or foul committed.

A player may not touch or move by hand any team spherical billiard ball or non-spherical billiard ball which is on the game playing region 340 during the course of a game. Touching or moving any spherical or non-spherical billiard ball on the game playing region 340 by hand voids the game and the game must be replayed. The team touching or moving the billiard ball receives a foul recordable on the score sheet.

A player is not required to call out his play or strategy in advance of rolling his team spherical billiard ball. However, strategic discussions between all players serve to provide the game with fun, controversy, competitiveness, and improved skills. Assistance may be requested or offered without solicitation by players within reason and in a manner that does not disrupt the flow or atmosphere of the game.

All players should conduct themselves with manners appropriate to the game. Socializing and strategy interaction is encouraged. However, actions which are intended to distract another player or cause another player to perform under his capabilities exhibit poor sportsmanship and should be avoided by all participants and spectators. Appropriate language is also encouraged so as not to offend surrounding players. Team captains are ultimately responsible for maintaining the integrity of the game, but all of the participants share the responsibility to make this happen.

Scoring is determined after all six spherical billiard balls from both teams have been rolled. The locations of the non-spherical billiard ball 300 and the spherical billiard balls must remain undisturbed until the score has been tallied and agreed upon by the two team captains.

The team with its spherical billiard ball closest to the non-spherical billiard ball 300 receives one point (called Team A for this description). If the second closest spherical billiard ball to the non-spherical billiard ball 300 is also from Team A, then Team A receives two points. If the third closes spherical billiard ball to the non-spherical billiard ball 300 is also from Team A, the Team A gets three points and so on up to a maximum of six points. Team A can earn the maximum of six points only if all six of their spherical billiard balls are closer to the non-spherical billiard ball 300 than are any of the spherical billiard balls of the opposing team (called Team B for this description). Team A's point accumulation stops when the next closest spherical billiard ball to the non-spherical billiard ball 300 is one from Team B. Because Team B's spherical billiard ball was not closest to the non-spherical billiard ball 300, Team B receives no points for the game.

Figure 9:
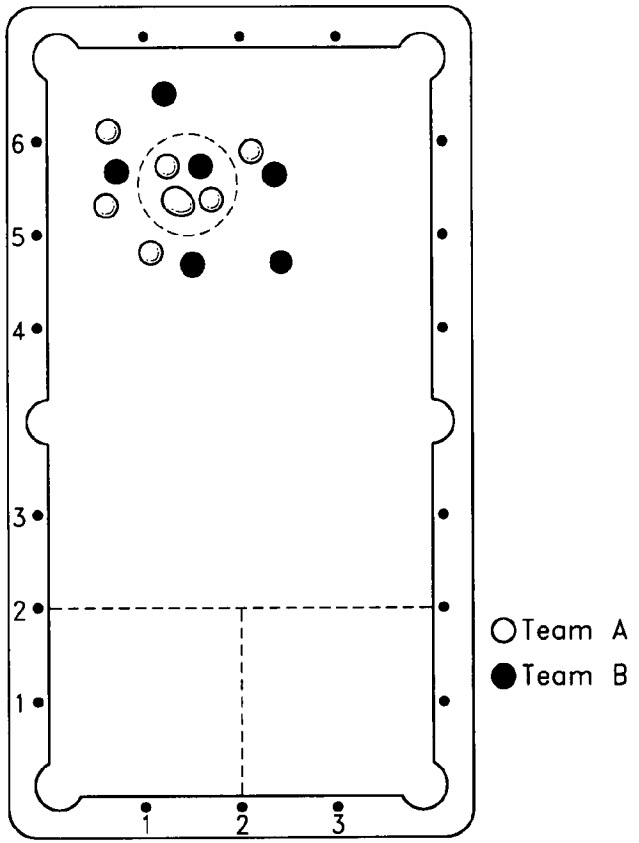
FIG. 9 schematically illustrates a configuration of spherical billiard balls and a non-spherical billiard ball for scoring purposes.

For example, referring to FIG. 9, after all the spherical billiard balls have been rolled, one of Team A's spherical billiard balls is closest to the non-spherical billiard ball 300. The second-closest spherical billiard ball to the non-spherical billiard ball 300 also belongs to Team A. The third-closest spherical billiard ball to the non-spherical billiard ball 300 belongs to Team B. This Team B spherical billiard ball stops the point accumulation of Team A, so that Team A receives a final score of two points for this game. Players from both teams may be involved in the score calculation, but the final score must be agreed upon by the two team captains and recorded on the score sheet. When the distance between two spherical billiard balls and the non-spherical billiard ball is too close to differentiate which spherical billiard ball is closer, a measuring device may be used to quantify the distance.

In the event of a draw and a decision cannot be determined or agreed upon, the following actions by the team captains will finalize the score. In the situation in which Team A has accumulated points, but the next possible point is questionable due to an equidistant spherical billiard ball belonging to Team B, the team captain of Team A will flip a coin and the team captain of Team B will make the call of heads or tails. If Team A wins the coin toss, Team A receives the point in question. If Team A loses the coin toss, Team A does not receive the point in question. For example, if Team A has two noncontested points, but the validity of the third point is questioned because Team A's third spherical billiard ball and Team B's first spherical billiard ball are both five inches from the non-spherical billiard ball, Team A receives three points if Team A wins the coin flip, and receives two points if Team A loses the coin flip. Other means of randomly choosing between Team A and Team B can be used instead of the coin flip.

In the situation in which both Team A and Team B both have their first spherical billiard balls equidistant from the non-spherical billiard ball so that the first point is questionable, both teams will receive one point toward their accumulated game points when a point scoring system is used and one-half point toward their accumulated game wins when a win scoring system is used. In one example of this situation, Team A has a spherical billiard ball which is touching the non-spherical billiard ball and Team B also has a spherical billiard ball which is touching the non-spherical billiard ball.

Before a measuring device is used, a preliminary score must be agreed upon by the two team captains. The location of the non-spherical billiard ball and the spherical billiard balls must continue to remain undisturbed until this preliminary score has been agreed upon. This preliminary score will be the basis for the final score in the event that a controversy or movement of the spherical billiard balls or non-spherical billiard ball occurs during the measurement process. Either or both of team captains may use the measuring device, but if both captains are hesitant to measure, the team captain of Team A will bear the responsibility to attempt a decision-making measurement. In the event that the measurement is inconclusive, controversial, or negated due to ball movement occurring during the measurement process, the agreed upon preliminary score will be finalized based on the appropriate action of the team captains applying the rules from the situations outlined above.

As in any game or competition, fairness and good sportsmanship should prevail. All players should strive to agreeably and accurately calculate points and wins so that controversy and questions may be minimized. When team captains are required to make final score decisions, the members of both teams should support the final outcome.

By using a score sheet (e.g., as illustrated by FIG. 10), teams may determine the winner by calculating their scores either on a point basis, a win basis or both (many league settings use a combination of both). Prior to the beginning of play, both teams or both captains should agree on the calculation method of determining the winner and also on how many games will be played if it will be different from the standard play of four sets. Fouls are scored and deducted as directed on the score sheet. The winner is the team that has the most points or wins as of the last game played after deducting for foul penalties.

In the event of a tie and a tie breaker game is desired, one final game may be played by a team player of the team captain's choice. The non-spherical billiard ball 300 can be placed in Position F2-S4 for this tie-breaking game.

Players may utilize various strategies (e.g., offensive and/or defensive strategies) during any roll executed. A player may chose to offensively roll his spherical billiard ball close to the non-spherical billiard ball 300 or defensively knock an opponent's spherical billiard ball away from the non-spherical billiard ball 300. Any strategy is acceptable as long as the rules are followed.

Many variations are possible for the game in terms of banking requirements, scoring requirements, and rotation requirements. One variation would be to play the game with a cue stick rather than rolling the billiard balls by hand. Because a cue stick brings more velocity and precision to the game, certain games require that only the spherical billiard ball which a player just shot may contact a cushion. After possible contact with other billiard balls, no other billiard ball (either his own or his opponents), except for the non-spherical billiard ball 300 may contact a cushion. If any other billiard ball, (other than the one just shot or the non-spherical billiard ball 300) touches a cushion, a foul is committed and the final score will be reduced according to the rules on the score sheet and the game continues.

EXAMPLE 2

Individual Bonus Round

A separate bonus round game may be incorporated between sets in order to allow players an opportunity to practice and exhibit their individual skills. During this bonus round game, individuals may accumulate points based on their own performance.

Figure 11:
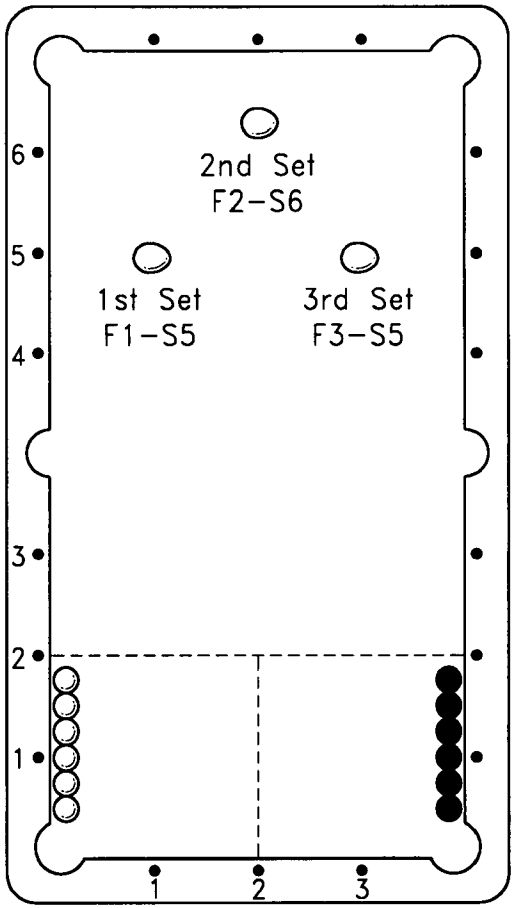
FIG. 11 schematically illustrates the starting positions of the non-spherical billiard ball for the bonus round games after each of the sets.

In this bonus round game, one non-spherical billiard ball and six spherical billiard balls are used. The non-spherical billiard ball 300 is set in the positions listed in Table 3, and schematically illustrated by FIG. 11, based on the set which is being played.

TABLE 3

| | |
|---|---|
| After first set | Position F1-S5 |
| After second set | Position F2-S6 |
| After third set | Position F3-S5 |

The six spherical billiard balls are lined up on either the right or left side rail between the foot rail and the foot string. A player may stand in any position behind the foot rail. A player is not required to stand on either the left or the right of the long string for this bonus round game.

The object of this bonus round game is to roll each of the six spherical billiard balls by hand toward the non-spherical billiard ball with the purpose of the spherical billiard ball contacting the non-spherical billiard ball. The spherical billiard ball rolled must bank against a minimum of one cushion on the table before contacting the non-spherical billiard ball. In one game variation, the requirement of using one bank may be eliminated for beginning players and the requirement of banking against two or more cushions may be added for advanced players.

The player rolls one spherical billiard ball at a time toward the non-spherical billiard ball with the goal of contacting the non-spherical billiard ball. The rolled spherical billiard ball must contact at least one cushion before contacting the non-spherical billiard ball. After contact with the cushion, the rolled spherical billiard ball may contact additional cushions or previously rolled spherical billiard balls without penalty. The rolled spherical billiard ball itself must contact the non-spherical billiard ball. If the rolled spherical billiard ball contacts another spherical billiard ball which in turn contacts the non-spherical billiard ball, but the rolled spherical billiard ball itself does not contact the non-spherical billiard ball, the roll does not result in a score.

If a rolled spherical billiard ball falls into a pocket, it is considered dead. If the rolled spherical billiard ball contacted the non-spherical billiard ball prior to falling into the pocket, the contact still results in a score. If the rolled spherical billiard ball did not contact the non-spherical billiard ball prior to falling into the pocket, the roll does not result in a score.

If the non-spherical billiard ball falls into a pocket, it is spotted to its original position. If the non-spherical billiard ball falls into a pocket upon being contacted by the rolled spherical billiard ball, the contact still results in a score. If the non-spherical billiard ball falls into a pocket due to contact by other spherical billiard balls, but was not contacted by the rolled spherical billiard ball, the roll does not result in a score.

The player receives one point for each spherical billiard ball that directly contacts the non-spherical ball up to a maximum of six points. The individual with the highest score is the winner.

EXAMPLE 3

Pocket Billiard Game of Eight-Ball Using a Non-Spherical Billiard Ball

In an example variation of Eight-Ball using a non-spherical billiard ball, the eight-ball is replaced with the non-spherical billiard ball within the rack of fifteen billiard balls. For this example, the cue ball and the other 14 numbered billiard balls are spherical.

All official rules of standard Eight-Ball apply when players are shooting at the spherical numbered billiard balls. When players are attempting to "tag" the non-spherical billiard ball, the following variation from the official rules apply.

A player must "tag" the non-spherical billiard ball with the cue ball prior to shooting at a numbered spherical billiard ball on the table. In certain variations, novice players may choose to allow the cue ball to tag the non-spherical billiard ball with a direct shot while skilled players may require the cue ball to contact a cushion prior to tagging the non-spherical billiard ball. After legally contacting a cushion, if required, a tag is considered legitimate as long as the cue ball contacts the non-spherical billiard ball. A player may contact either his own or his opponent's numbered spherical billiard balls in the attempt to tag the non-spherical billiard ball. However, if contacting a cushion first is required, the cushion must be contacted first before contacting any other numbered spherical billiard balls. A player does not have to call his shot, method, or indicate details such as number of cushions, banks, kisses, or caroms when attempting to tag the non-spherical billiard ball.

If a player pockets the non-spherical billiard ball during the tagging attempt, the non-spherical billiard ball is spotted on the foot spot. If the cue ball legally tagged the non-spherical billiard ball prior to the non-spherical billiard ball being pocketed, the non-spherical billiard ball is spotted and the player may continue his turn. If the cue ball did not legally tag the non-spherical billiard ball prior to the non-spherical billiard ball being pocketed, the non-spherical billiard ball is spotted, the player loses his turn, and the incoming player has an opportunity to tag the non-spherical billiard ball with the cue ball.

If a player fails to tag the non-spherical billiard ball during the tagging attempt, the player loses his turn and the incoming player has an opportunity to tag the non-spherical billiard ball with the cue ball. Any opponent's billiard ball pocketed during the attempt to tag the non-spherical billiard ball remains pocketed. Any billiard ball pocketed of one's own team during the attempt to tag the non-spherical billiard ball is spotted on the foot spot. Failing to tag the non-spherical billiard ball always results in loss of turn. If a player pockets the cue ball in his attempt to "tag" the non-spherical billiard ball, the player loses his turn and the incoming player has ball in hand with the cue ball.

Once a player has successfully "tagged" the non-spherical billiard ball, the player may shoot at a numbered spherical billiard ball within his designated group. All official rules of Eight-Ball apply during the player's shot attempt at this point. If the player does not successfully pocket his numbered spherical billiard ball, he loses his turn and the incoming player begins his turn by attempting to successfully "tag" the non-spherical billiard ball with the cue ball. If the player does successfully pocket his numbered spherical billiard ball, his play continues, but he must successfully "tag" the non-spherical billiard ball again with the cue ball before attempting to pocket the next numbered spherical ball in his group. If he once again successfully "tags" the non-spherical billiard ball, his turn continues. If he fails to successfully "tag" the non-spherical billiard ball, he loses his turn and the incoming player begins his turn by attempting to successfully "tag" the non-spherical billiard ball with the cue ball. In summary, the non-spherical billiard ball must always by "tagged" by the cue ball prior to a player shooting at a numbered spherical billiard ball of his grouping.

When a player has pocketed all of the numbered spherical billiard balls of his group, he must contact the non-spherical billiard ball with the cue ball by hitting a minimum of two cushions first. Novice players may require contacting only one cushion and skilled players may require contacting up to three or four cushions. If he fails to contact the non-spherical billiard ball with the cue ball, he loses his turn and the incoming player begins his turn by attempting to successfully "tag" the non-spherical billiard ball with the cue ball. If the incoming player also has pocketed all the numbered spherical billiard balls in his group, he must "tag" the non-spherical billiard ball with the minimum number of cushion contacts required. The player pocketing either group of numbered spherical billiard balls first and then legally "tagging" the non-spherical billiard ball wins the game.

After a player pockets his group of numbered spherical billiard balls and is attempting to win the game with a legal tag, various scenarios may occur. If the non-spherical billiard ball is pocketed, but a legal contact by the cue ball was made, the player wins the game. If the non-spherical billiard ball is pocketed, but a legal contact by the cue ball was not made, the player loses his turn, the non-spherical billiard ball is spotted on the foot spot, and the incoming player begins his turn by attempting to successfully "tag" the non-spherical billiard ball. If the cue ball is pocketed after a legal contact to the non-spherical billiard ball was made, the player loses his turn and the incoming player receives ball in hand with the cue ball. If the cue ball is pocketed, but a legal contact by the cue ball to the non-spherical billiard ball was not made, the player loses his turn and the incoming player receives ball in hand with the cue ball.

Other standard billiard games may also be modified to be played by using the variation of "tagging" the non-spherical billiard ball as described above. Examples include, but are not limited to, Nine-Ball in which the nine-ball is replaced by the non-spherical billiard ball, Poker Pool in which the eight-ball is replaced by the non-spherical billiard ball, Seven-Ball in which the seven-ball is replaced by the non-spherical billiard ball, and Ten-Ball in which the ten-ball is replaced by the non-spherical billiard ball.

Various embodiments have been described above. Although this invention has been described with reference to these specific embodiments, the descriptions are intended to be illustrative of the invention and are not intended to be limiting. Various modifications and applications may occur to those skilled in the art without departing from the true spirit and scope of the invention as defined in the appended claims.

What is claimed is:

1. A method of playing a game, the game comprising:

providing a first plurality of spherical billiard balls to a first team of one or more players;

providing a second plurality of spherical billiard balls to a second team of one or more players;

placing a non-spherical billiard ball on a surface, the non-spherical billiard ball having an ellipsoidal or ovoidal shape and a generally smooth outer surface lacking a concave portion, wherein the surface is a table surface having one or more cushioned rails along corresponding edges of the surface;

alternating turns by the first team and the second team, wherein a turn comprises rolling at least one spherical billiard ball along the surface generally towards the non-spherical billiard ball by rolling the at least one spherical billiard ball towards the one or more cushioned rails such that the at least one spherical billiard ball impacts the one or more cushioned rails and changes trajectory generally towards the non-spherical billiard ball, wherein the turn results in a foul if the at least one spherical billiard ball does not impact the one or more cushioned rails before contacting the non-spherical billiard ball or any other spherical billiard balls; and tallying scores for the first team and for the second team, wherein the scores are indicative of distances between the non-spherical billiard ball and balls of the first plurality of spherical billiard balls and distances between the non-spherical billiard ball and balls of the second plurality of spherical billiard balls.

2. The method of claim 1, wherein the surface is a surface of a billiards table.

3. The method of claim 1, wherein the spherical billiard ball has a generally incompressible body having a weight in a range between 5 ounces and 8 ounces and a diameter in a range between 2 inches and 2.5 inches.

4. The method of claim 1, wherein the non-spherical billiard ball has a generally incompressible body having a weight in a range between 5 ounces and 8 ounces.

5. The method of claim 4, wherein the non-spherical billiard ball has a first diameter along a first direction and a second diameter along a second direction substantially perpendicular to the first direction, the first diameter larger than the second diameter.

6. The method of claim 5, wherein the first diameter is in a range between 2 inches and 3 inches, the second diameter is in a range between 1.5 inches and 2.5 inches.

7. The method of claim 1, wherein placing the non-spherical billiard ball on the surface comprises imparting a force on the non-spherical billiard ball to roll the non-spherical billiard ball along the surface.

8. The method of claim 7, wherein the force is imparted manually.

9. The method of claim 7, wherein the force is imparted by striking the non-spherical billiard ball with a stick.

10. The method of claim 7, wherein the force is imparted by striking the non-spherical billiard ball with a spherical billiard ball.

11. The method of claim 1, wherein rolling the at least one spherical billiard ball along the surface comprises imparting a force on the at least one spherical billiard ball manually.

12. The method of claim 1, wherein rolling the at least one spherical billiard ball along the surface comprises imparting a force on the at least one spherical billiard ball by striking the at least one spherical billiard ball with a stick.

13. The method of claim 1, wherein rolling the at least one spherical billiard ball along the surface comprises imparting a force on the at least one spherical billiard ball by striking the at least one spherical billiard ball with another spherical billiard ball.

14. The method of claim 1, wherein rolling the at least one spherical billiard ball generally towards the non-spherical billiard ball comprises rolling the at least one spherical billiard ball towards a first cushioned rail such that the at least one spherical billiard ball impacts the first cushioned rail and changes trajectory towards a second cushioned rail, impacts the second cushioned rail and changes trajectory generally towards the non-spherical billiard ball.

15. The method of claim 1, further comprising placing a second non-spherical billiard ball on the surface of the table, the second non-spherical billiard ball having an ellipsoidal or ovoidal shape with a generally smooth outer surface lacking a concave portion.

16. The method of claim 15, further comprising rolling the at least one spherical billiard ball along the surface generally towards the second non-spherical billiard ball.

17. The method of claim 1, wherein each spherical billiard ball of the first plurality of spherical billiard balls has one or more corresponding indicia with a first element common among the indicia of the first plurality of spherical billiard balls, and each spherical billiard ball of the second plurality of spherical billiard balls has one or more corresponding indicia with a second element common among the indicia of the second plurality of spherical billiard balls, the second element different from the first element.

18. A method of playing a game between a first team of one or more players and a second team of one or more players, the game comprising:

placing a cue ball on a table comprising a plurality of cushioned rails along corresponding edges of the table;

placing a plurality of spherical billiard balls on the table;

placing a non-spherical billiard ball on the table, the non-spherical billiard ball having an ellipsoidal or ovoidal shape and a generally smooth outer surface lacking a concave portion; and alternating turns by the first team and the second team, wherein a turn comprises:

(a) striking the cue ball with a stick a first time such that the cue ball rolls along the surface generally towards the non-spherical billiard ball, wherein the turn continues if the cue ball contacts the non-spherical billiard ball, wherein the turn ends if the cue ball does not contact the non-spherical billiard ball; and (b) upon the turn continuing, striking the cue ball with a stick a second time after the first time such that the cue ball rolls along the surface and impacts at least one spherical billiard ball of the plurality of spherical billiard balls, the table further comprises a plurality of pockets and the turn continues if a predetermined goal is achieved and the turn ends if the predetermined goal is not achieved; and wherein the predetermined goal is achieved by pocketing at least one of the plurality of spherical billiard balls, and the predetermined goal is not achieved if none of the spherical billiard balls is pocketed.

19. The method of claim 18, further comprising repeating steps (a) and (b) until the turn ends.

20. The method of claim 18, wherein placing the non-spherical billiard ball on the surface comprises imparting a force on the non-spherical billiard ball to roll the non-spherical billiard ball along the surface.

21. The method of claim 20, wherein the force is imparted manually.

22. The method of claim 20, wherein the force is imparted by striking the non-spherical billiard ball with a spherical billiard ball.

23. The method of claim 18, wherein step (a) comprises rolling the cue ball towards the one or more cushioned rails such that the cue ball impacts the one or more cushioned rails and changes trajectory generally towards the non-spherical billiard ball.

24. The method of claim 23, wherein step (a) comprises rolling the cue ball towards a first cushioned rail such that the cue ball impacts the first cushioned rail and changes trajectory towards a second cushioned rail, impacts the second cushioned rail and changes trajectory generally towards the non-spherical billiard ball.

* * * * *